United States Patent [19]

Meyer

[11] 4,421,474

[45] Dec. 20, 1983

[54] HYDROGEN GAS BURNER

[76] Inventor: Stanley A. Meyer, 2222 Marlane Dr., Grove City, Ohio 43213

[21] Appl. No.: 411,245

[22] Filed: Aug. 25, 1982

[51] Int. Cl.[3] ..... F23L 7/00

[52] U.S. Cl. ..... 431/115; 431/4; 431/347; 431/353; 431/354; 432/222; 48/180 C

[58] Field of Search ..... 431/4, 5, 115, 116, 431/263, 265, 328, 347, 350, 351, 353, 354, 355, 190; 432/222; 48/180 C, 180 B, 180 F

[56] References Cited

U.S. PATENT DOCUMENTS

| | | | |
|---|---|---|---|
| 416,130 | 11/1889 | Walters | 431/115 |
| 2,386,978 | 10/1945 | Ruhl | 48/180 F |
| 2,701,608 | 2/1955 | Johnson | 431/116 |
| 3,705,784 | 12/1972 | Reichhelm et al. | 431/116 |
| 3,868,211 | 2/1975 | La Haye et al. | 431/10 |
| 4,021,191 | 5/1977 | La Haye | 431/353 |

*Primary Examiner*—Lee E. Barrett
*Attorney, Agent, or Firm*—Anthony D. Cennamo; 40

[57] ABSTRACT

A hydrogen gas burner for the mixture of hydrogen gas with ambient air and non-combustible gasses. The mixture of gasses when ignited provides a flame of extremely high, but controlled intensity and temperature. The structure comprises a housing and a hydrogen gas inlet directed to a combustion chamber positioned within the housing. Ambient air intake ports are provided for adding ambient air to the combustion chamber for ignition of the hydrogen gas by an ignitor therein. At the other end of the housing there is positioned adjacent to the outlet of the burner (flame) a barrier/-heating element. The heating element uniformly disperses the flame and in turn absorbs the heat. The opposite side to the flame, the heating element uniformly disperses the extremely hot air. A non-combustible gas trap adjacent to the heating element captures a small portion of the non-combustible gas (burned air). A return line from the trap returns the captured non-combustible gas in a controlled ratio to the burning chamber for mixture with the hydrogen gas and the ambient air.

13 Claims, 2 Drawing Figures

HYDROGEN GAS BURNER

CROSS REFERENCE

The hydrogen/oxygen generator utilized in the present invention is that disclosed and claimed in my co-pending patent application, Ser. No.: 302,807, filed: Sept. 16, 1981, for: HYDROGEN GENERATOR SYSTEM. In that process for separating hydrogen and oxygen atoms from water having impurities, the water is passed between two plates of similar non-oxidizing metal. No electrolyte is added to the water. The one plate has placed thereon a positive potential and the other a negative potential from a very low amperage direct-current power source. The sub-atomic action of the direct current voltage on the non-electrolytic water causes the hydrogen and oxygen atoms to be separated—and similarly other gasses entrapped in the water such as nitrogen. The contaminents in the water that are not released are forced to disassociate themselves and may be collected or utilized and disposed of in a known manner.

The direct current acts as a static force on the water molecules; whereas the non-regulated rippling direct current acts as a dynamic force. Pulsating the direct current further enhances the release of the hydrogen and oxygen atoms from the water molecules.

In my co-pending patent application, Ser. No.: 262,744, filed: May 11, 1981, for: HYDROGEN AIRDATION PROCESSOR, there is disclosed and claimed the utilization of the hydrogen/oxygen gas generator. In that system, the burn rate of the hydrogen gas is controlled by the controlled addition of non-combustible gasses to the mixture of hydrogen and oxygen gasses.

PRIOR ART

The electrolysis process for generating hydrogen and oxygen gas is well known in the art. It is, of course, further understood with a proper mixture of oxygen gas, the hydrogen gas is combustible and under ideal conditions a flame, may be had. Reference is made to U.S. Pat. No.: 4,184,931. However, in that the burning velocity of hydrogen is 265–325 cm./sec. versus 37–45 cm./sec. of that of gasoline, the velocity of hydrogen is so great that the hydrogen ensuing from a nozzle will not under ordinary circumstances sustain a flame.

Therefore, to sustain a flame at a nozzle attached to a hydrogen generator the burning velocity of the hydrogen gas must be reduced.

It has been found that all water in its natural state whether it be tap water, well water, sea water, or fresh water is a saturate of ambient air. Further, in that ambient air contains a substantial amount of nitrogen, all natural water will have entrapped therein nitrogen. Again, the percentage of nitrogen entrapped in natural water has been determined to be a fixed percentage and very uniform at seventeen (17%) percent—irrespective of the source of the water or its impurities. Hence, a natural water gas analysis will show a seventeen percent of nitrogen relative to the hydrogen and the oxygen.

The nozzle connected to the collection chamber via an appropriate line, has a port opening of a controlled size and configuration, related to the size of the flame and the temperature and velocity of the burning gas mixture. To maintain the flame, that is to prevent blowout, additional nozzles are included when the overall flame size is to be increased.

SUMMARY OF INVENTION

The present invention is for a hydrogen gas burner and comprises a combustion chamber for the mixture of hydrogen gas, ambient air, and non-combustible gasses. The mixture of gasses is ignited and burns at a retarded velocity rate and temperature from that of hydrogen gas, but at a higher temperature rate than other gasses.

The extremely narrow hydrogen gas mixture flame of very high temperature is restricted from the utilization means by a heat absorbing barrier. The flame strikes the barrier which in turn disperses the flame and absorbs the heat therefrom and thereafter radiates the heat as extremely hot air into the utilization means.

Positioned on the opposite side of the heat radiator/-barrier is a hot air trap. A small portion of the radiated heat is captured and returned to the combustion chamber as non-combustible gasses. Valve means in the return line regulates the return of the non-combustible gas in a controlled amount to control the mixture.

The present invention is principally intended for use with the hydrogen generator of my co-pending patent application, supra; but it is not to be so limited and may be utilized with any other source of hydrogen gas.

OBJECTS

It is accordingly a principal object of the present application to provide a hydrogen gas burner that has a temperature controlled flame and a heat radiator/barrier.

Another object of the present invention is to provide a hydrogen gas burner that is capable of utilizing the heat from a confined high temperature flame.

Another object of the present invention is to provide a hydrogen gas burner that is retarded from that of hydrogen gas, but above that of other gasses.

Another object of the present invention is to provide a hydrogen gas burner that utilizes the exhaust air as non-combustible gas for mixture with the hydrogen gas.

Another object of the present invention is to provide a hydrogen gas burner that is simple but rugged and most importantly safe for all intended purposes.

Other objects and features of the present invention will become apparent from the following detailed description when taken in conjunction with the drawings in which:

DETAILED DESCRIPTION OF INVENTION

Figure 1:
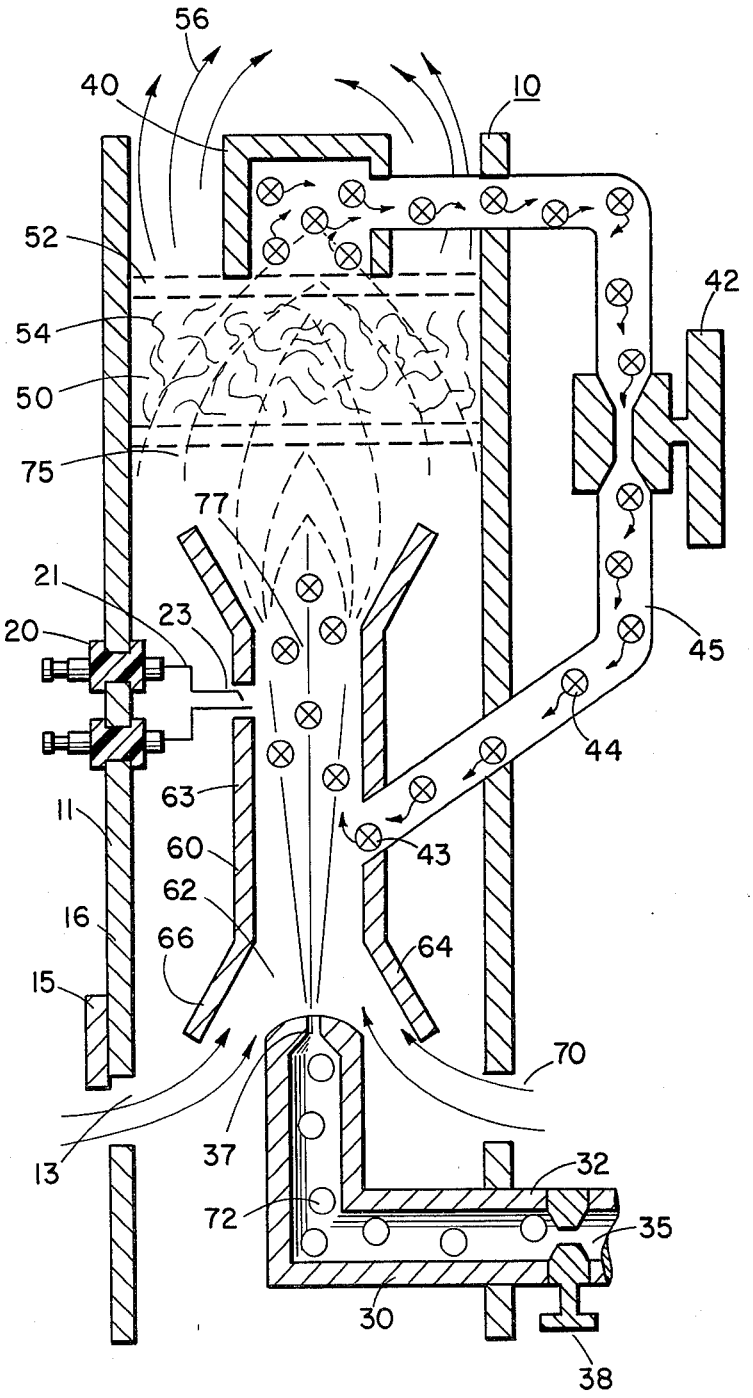
FIG. 1 is an overall crossectional view of the present invention in its most preferred embodiment.

With particular reference FIG. 1 there is illustrated in a schematic crossection the principals of the present invention.

The structure of the preferred embodiment comprises a housing 10, having an igniter 20 extending through the wall 11 thereof. A combustion chamber 60 positioned within the housing 10 has a first open end 62. A hydrogen gas 72 inlet 30 directs hydrogen gas via port 37 from a source 35 to the inlet 62 of the combustion chamber 68. Also directed to the same inlet 62, and assisted by flanges 64 and 66, is ambient air 70 entering through ports 13 in the housing 10.

Adjacent the opposite end of the combustion chamber 60 the gas mixture 75 is ignited by the ignitor 20 to produce flame 77.

The velocity of the flame 77 causes it to strike and penetrate the barrier/radiator 50. The barrier 50 is of a material, such as metallic mesh or ceramic material, to disperse therein the flame and in turn become saturated with heat. The flame 77 is of a size sufficient to be dispersed throughout the barrier 50, but yet, not penetrate through the barrier 50.

Radiated from the surface 52 of the barrier 50 is superheated air 56 (gasses) to be passed on to a utilization device.

Adjacent to surface 52 of barrier/radiator 50 is a hot air trap 40 with closed loop line 45 returning non-combustible gas 44 to the combustion chamber 60. Control valve 42 is intermediate the line 45.

In operation of the preferred embodiment hydrogen gas, 72, emitted from the nozzle 37 is directed to the combustion chamber 60. The flanges 64 and 66 on the open end of housing 63 of the combustion chamber 60 enlarges the open end of 62. In the enlargement ambient air from the opening 13 in the housing 10 is also directed to the combustion chamber 60.

The ambient air and hydrogen traverses the opening 43 and further mixes with the non-combustible gas 44 from the closed loop line 45 with the hot air trap 40.

The mixture of hydrogen gas 72, ambient air 70, and non-combustible gas 44, is ignited by the ignitor 20 having electrical electrodes 21 and 23. Upon ignition flame 77 ensues.

The mixture is controlled with each of three gasses. That is, the line 32 from the hydrogen source 35 has a valve 38 therein for controlling the amount of hydrogen 72 emitted from the nozzle 37. The opening 13 has a plate adjustment 15 for controlling the amount of ambient air 60 directed to the combustion chamber 60, and the closed-loop line has valve 42, as aforesaid, for controlling the amount of non-combustible gasses in the mixture.

It can be appreciated that the temperature of the flame 77 and the velocity of the flame 77 is a function of the percentage of the various gasses in the mixture. In a practical embodiment, the flame 70 temperature and velocity was substantially retarded from that of a hydrogen flame per se; but yet, much greater than the temperature and velocity of the flame from the gasses utilized in a conventional heating system.

To maintain a sufficient pressure for combustion of the hydrogen gas mixture with a minimum of pressure (for safety) and to limit blowout, the nozzle 37 opening 39 is extremely small. As a consequence, if the hydrogen gas were burned directly from the nozzle 37, the flame would be finite in diameter. Further, its velocity would be so great it is questionable whether a flame could be sustained.

The mixing of ambient air and non-combustible gas does enlargen the flame size and does reduce its velocity. However, to maintain a flame higher in temperature and velocity than the conventional gasses, the size and temperature of the flame is controlled by the aforementioned mixture.

Therefore, to utilize the flame 77 in a present day utilization means, the flame is barred by the barrier 50. The barrier 50 is of a material that can absorb safely the intense flame 77 and thereafter radiate heat from its entire surface 52. The material 54 can be a ceramic, metallic mesh or other heat absorbing material known in the art. The radiated heat 56 is directed to the utilization means.

As aforesaid, the mixture of gasses that are burned include non-combustible gasses. As indicated in the above-noted co-pending patent applications, an excellent source of non-combustible gasses are exhaust gasses. In this embodiment, the trap 50 entraps the hot air 74 and returns the same, through valve 42, to the combustion chamber 60 as non-combustible gas.

Figure 2:
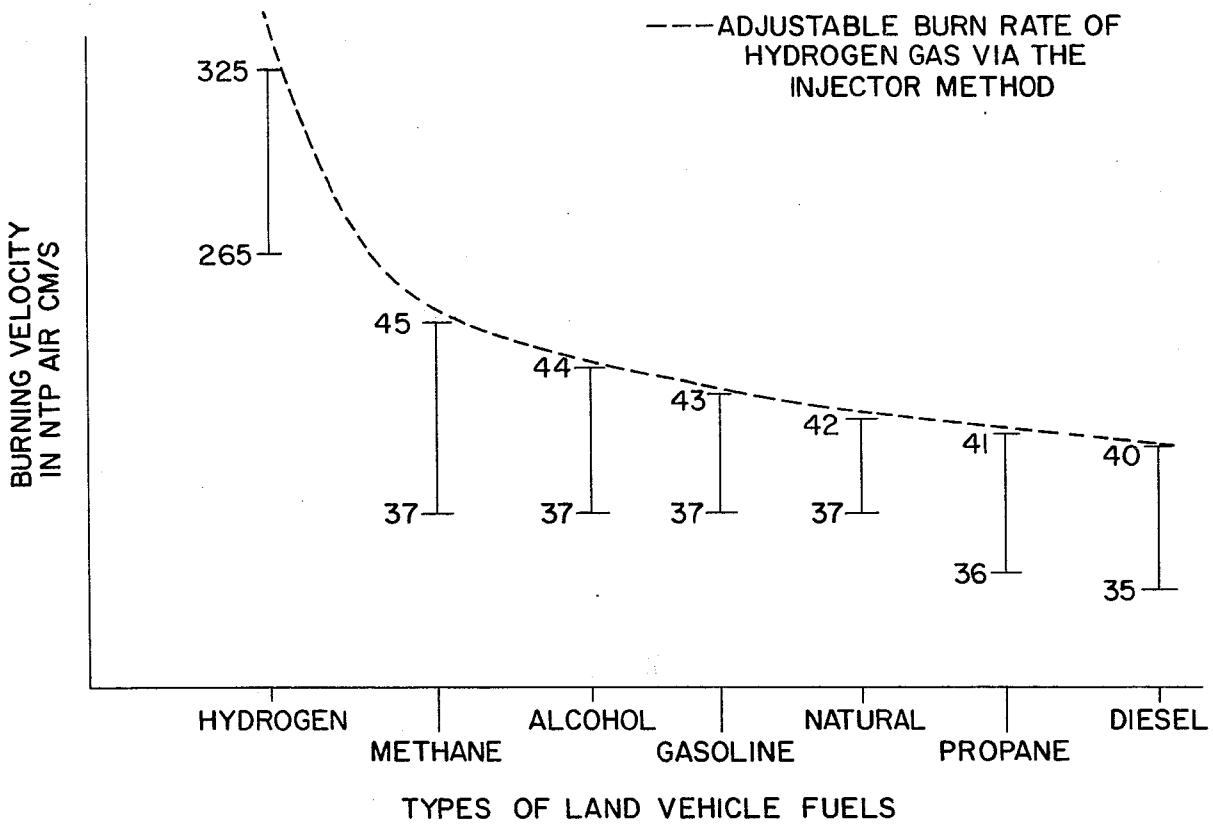
FIG. 2 is a graphical illustration of the burning of various standard fuels with that of hydrogen velocities.

With reference to FIG. 2 there is illustrated the burning velocity of various standard fuels. It can be seen the common type of fuel burns at a velocity substantially less than hydrogen gas.

The ratio of hydrogen with non-combustible oxygen gasses is varied to obtain optimum burning velocity and temperature for the particular utilization. Once this is attained, the ratio, under normal conditions, will not be altered. Other uses having different fuel burn temperature and velocity will be adjusted in ratio of hydrogen-/oxygen to non-combustible gasses in the same manner as exemplified above.

Further, perhaps due to the hydrogen gas velocity, there will occur unburnt gas at the flame 77 output. The barrier 50, because of its material makeup will retard the movement and entrap the unspent hydrogen gas. As the superheated air 77 is dispersed within the material 54, the unspent hydrogen gas is ignited and burns therein. In this way the barrier 50 performs somewhat in the nature of an after burner.

I claim:

1. A hydrogen gas burner for utilization as a heat source comprising:

a housing having a double open-end combustion chamber positioned therein, a source of hydrogen gas and a nozzle connected thereto for directing the hydrogen gas into one end of said combustion chamber, ambient air intake means in said housing positioned to direct ambient air into said combustion chamber, and a source of a non-combustible gas, return line means for returning said non-combustible gas to said combustion chamber for mixing with said hydrogen gas and said ambient air, an ignitor for igniting said mixture of gasses, a barrier positioned adjacent to other open-end of said combustion chamber, said ignited mixture of gasses superheating the air in said housing and directing the same to said barrier, said barrier further comprising a heat dissapating surface to disperse heated air to the utilization means.

2. The hydrogen gas burner of claim 1 wherein said source of non-combustible gas further comprises a hot air trap adjacent to the heat dissapating surface of said barrier and a return line from said trap to said combustion chamber.

3. The hydrogen gas burner of claim 1 wherein said return line further comprises valve means for controlling the amount of non-combustible gas entering said combustion chamber.

4. The hydrogen gas burner of claim 1 wherein said ambient air intake means is positioned in said housing to provide ambient air to said combustion chamber together with said hydrogen gas.

5. The hydrogen gas burner of claim 1 wherein said ambient air intake means in said housing further comprises a valve means for controlling the amount of ambient air entering said combustion chamber.

6. The hydrogen gas burner of claim 1 wherein said source of hydrogen gas further comprises a valve means for controlling the amount of hydrogen gas introduced to said combustion chamber.

7. The hydrogen gas burner of claim 1 wherein said hydrogen gas, said ambient air, and said non-combustible gasses are controlled in amount to a predetermined ratio dependant upon the desired velocity and temperature of the ensuing flame.

8. The hydrogen gas burner of claim 1 wherein said nozzle has a port opening of a controlled size to provide a constant flame without blowout.

9. The hydrogen gas burner of claim 1 wherein said barrier comprising a heat saturating material with a heat dissapating surface.

10. The hydrogen gas burner of claim 9 wherein said heat absorbing/dissapating barrier comprises a ceramic material.

11. The hydrogen gas burner of claim 9 wherein said heat absorbing/dissapating barrier comprises a metallic mesh material.

12. The hydrogen gas burner of claim 1 wherein said opening in said combustion chamber further comprises flange means for directing said hydrogen gas and said ambient air thereto.

13. The hydrogen gas burner of claim 9 wherein said barrier retards unspent hydrogen gas atoms and thereafter ignites the same.

* * * * *